US007518958B2

(12) United States Patent
Ishii

(10) Patent No.: US 7,518,958 B2
(45) Date of Patent: Apr. 14, 2009

(54) GPS-ASSISTED MOBILE PHONE CLOCK FOR USE IN NON-DIGITAL SERVICE COVERAGE AREAS

(75) Inventor: Atsushi Ishii, Vancouver, WA (US)

(73) Assignee: Sharp Laboratories of America, Inc., Camas, WA (US)

( * ) Notice: Subject to any disclaimer, the term of this patent is extended or adjusted under 35 U.S.C. 154(b) by 1091 days.

(21) Appl. No.: 10/738,936

(22) Filed: Dec. 17, 2003

(65) Prior Publication Data

US 2005/0135194 A1 Jun. 23, 2005

(51) Int. Cl.
*G04C 11/02* (2006.01)

(52) U.S. Cl. ..... 368/47; 368/46; 455/456.1; 342/357.06

(58) Field of Classification Search ..... 368/47, 368/46; 455/456.1; 342/357.06
See application file for complete search history.

(56) References Cited

U.S. PATENT DOCUMENTS 5,724,316 A * 3/1998 Brunts ..... 368/10
5,945,944 A 8/1999 Grasner
6,009,130 A * 12/1999 Lurey et al. ..... 375/347
6,150,980 A 11/2000 Krasner
6,252,543 B1 6/2001 Camp
6,389,291 B1 5/2002 Pande et al.
6,411,811 B2 6/2002 Kingson et al.
6,427,120 B1 7/2002 Garin et al.
6,430,415 B1 8/2002 Agashe et al.
6,433,734 B1 8/2002 Krasner
7,190,946 B2 * 3/2007 Mazzara et al. ..... 455/404.1
2001/0050633 A1 12/2001 Thomas
2002/0098857 A1 7/2002 Ishii

* cited by examiner

*Primary Examiner*—Vit W Miska
*Assistant Examiner*—Sean Kayes
(74) *Attorney, Agent, or Firm*—David C. Ripma

(57) ABSTRACT

A method of setting an internal clock in a GPS-equipped mobile communication device when the mobile communication device is not in a digital service area includes determining whether digital service is available, including determining whether digital service is available by determining the elapsed time from the last receipt of a digital service contact, and, if digital service is not available, detecting a GPS time signal from a single GPS satellite.

13 Claims, 1 Drawing Sheet

GPS-ASSISTED MOBILE PHONE CLOCK FOR USE IN NON-DIGITAL SERVICE COVERAGE AREAS

FIELD OF THE INVENTION

The invention relates to GPS-equipped digital mobile phones, and specifically to such a mobile phone which is able to maintain correct internal time when not in range of a digital phone base station.

BACKGROUND OF THE INVENTION

Today, almost all mobile phones are equipped with a clock, including PDA's, which also maintain calendaring, and, in some instances, EMail and Browser functions. In some digital cellular/PCS systems, such as the IS-95/2000 CDMA system, the clock in a phone is synchronized to the precise local time (Coordinated Universal Time (UTC)+time zone) given by the base station to which the phone is currently communicating with. Once synchronized, the mobile station maintains the clock until the phone is turned off. As a result, users of such phones do not have to adjust the in-phone clocks while they are in a digital service coverage area.

However, if the mobile phone is powered up outside of a digital service coverage area, the mobile station will lose the current time, unless it is equipped with a battery-back-up real-time clock hardware (RTC). The RTC maintains the clock while the mobile phone is turned off, but requires extra physical space within the phone and increases the manufacturing costs. For a mobile phone without an RTC, applications that rely on the clock do not function when the current time is lost. For example, in such a case the "alarm clock" feature will miss the time at which it is supposed to give a visual/audible alert to the user.

In addition, because a RTC is normally driven by a low-cost crystal oscillator with only marginal accuracy, the mobile phone may not have a sufficiently accurate clock even if it is equipped with an RTC.

Some mobile phones provide the capability for users to set the current time manually. However, a user may not be aware of the need to set manual time, or may forget to set time manually, and thereby not receive important clock-dependent information, or receive the information at an inappropriate time.

The United States Federal Communications Commission (FCC) mandates that mobile phone manufacturers integrate a position determining mechanism in their products, in order to locate emergency callers. Today, the technology of Global Positioning System (GPS) is widely used for such position determination. Thus, it is expected that majority of newly manufactured mobile phones will be shipped with a GPS receiver. In such a phone, the GPS receiver is typically activated while synchronized to a base station that provides digital cellular/PCS services.

U.S. Pat. No. 6,433,734, of Krasner, granted Aug. 13, 2002, for Method and apparatus for determining time for GPS receivers, describes a method of using time information obtained from cellular network to calibrate a GPS receiver.

U.S. Pat. No. 6,430,415, of Agashe et al., granted Aug. 6, 2002, for Method and apparatus for locating GPS equipped wireless devices operating in analog mode, describes a method for locating a mobile device that may not have a sense of network time.

U.S. Pat. No. 6,427,120, of Garin et al., granted Jul. 30, 2002, for Information transfer in a multi-mode global positioning system used with wireless networks, describes methods for a GPS receiver to switch operation modes, such as between a stand alone mode and a network-aided mode.

U.S. Pat. No. 6,411,811, of Kingdon et al., granted Jun. 25, 2002, for System and method for provisioning assistance global positioning system information to a mobile station, describes a method for a cellular network to determine a mobile station's location, but does not provide any mechanism for managing the mobile station's clock.

U.S. Pat. No. 6,389,291, of Pande et al., granted May 14, 2002, for Multi-mode global positioning system for use with wireless networks, describes a method for a GPS receiver to switch operation modes, such as between a stand alone mode and a network-aided mode, but does not provide a mechanism for setting receiver time while outside of cellular coverage.

U.S. Pat. No. 6,252,543, of Camp, granted Jun. 26, 2001, for Location system combining ranging measurements from GPS and cellular networks, describes a method of combining information from both GPS satellites and cellular base stations to improve location determination.

U.S. Pat. No. 6,150,980, of Krasner, granted Nov. 21, 2000, for Method and apparatus for determining time for GPS receivers, describes a method of using time information obtained from cellular network for a GPS receiver, but does not teach or suggest use of a GPS signal to set an internal clock in the mobile communication device.

U.S. Pat. No. 5,945,944, of Krasner, granted Aug. 31, 1999, for Method and apparatus for determining time for GPS receivers, describes a method of using time information obtained from cellular network for a GPS receiver.

My U.S. Patent Publication No. 2002/0098857 A1, published Jul. 25, 2002, for Clock for mobile phones, describes a method of managing time zone changes for mobile devices.

United States Publication No. 2001/0050633 A1, of Thomas, published Dec. 13, 2001, for Land based method and apparatus for providing precise time and position (terrestrial alternative of the global positioning system—GPS), describes a method for providing precise time information from the GPS network to mobile GPS receiving unit.

SUMMARY OF THE INVENTION

A method of setting an internal clock in a GPS-equipped mobile communication device when the mobile communication device is not in a digital service area includes determining whether digital service is available, including determining whether digital service is available by determining the elapsed time from the last receipt of a digital service contact, and, if digital service is not available, detecting a GPS time signal from a single GPS satellite.

It is an object of the invention to provide a digital mobile phone which is able to maintain correct time when not in contact with a digital phone base station.

Another object of the invention is to provide a GPS-equipped digital mobile phone with a mechanism for setting its internal clock as a function of a GPS signal.

This summary and objectives of the invention are provided to enable quick comprehension of the nature of the invention. A more thorough understanding of the invention may be obtained by reference to the following detailed description of the preferred embodiment of the invention in connection with the drawings.

DETAILED DESCRIPTION OF THE PREFERRED EMBODIMENT

Figure 1:
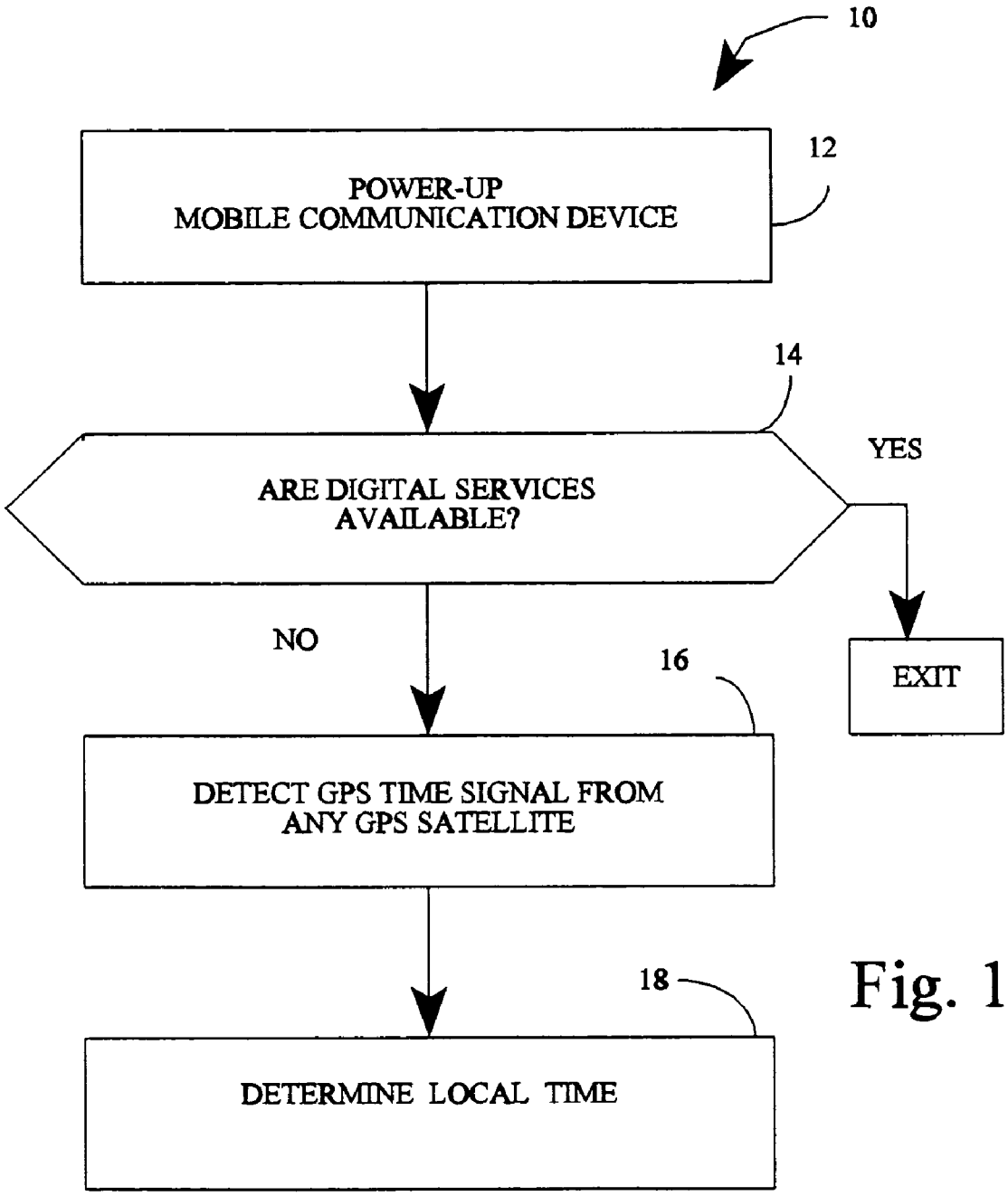
FIG. 1 is a block diagram of the invention.

The present invention allows a GPS-equipped digital mobile phone, or other mobile communication device, located outside of a digital service coverage area to maintain internal clock time in a manner which is sufficiently accurate for most of applications. Referring to FIG. 1, the method of the invention is depicted generally at 10. The phone is powered up, 12. When the mobile phone fails to discover digital services 14 upon power-up, it activates its GPS receiver to decode a signal from the GPS satellite system 16. Each GPS satellite periodically broadcasts a navigation message, including position-determination-related parameters and GPS time information. For purposes of time acquisition, the mobile phone of the present invention requires decoding only the GPS time information from a GPS time signal from a single satellite, vs. for position determination, wherein the GPS receiver portion of the phone is required to receive signals from multiple satellites and to perform time/power-consuming processes for the position-determination-related parameters. The GPS time information includes GPS Week and Time of Week-fields, which the mobile station is able to convert to UTC time for adjusting its internal clock.

Local time, if desired, may be determined based on user location, 18. User location may be determined by well-known state-of-the-art techniques using plural GPS satellites to determine the location of the user and phone on the surface of the Earth. The latitude and longitude may be correlated with a time zone table contained in phone memory to determine the time zone in which the user is located, and to set local time accordingly. Alternately, clock events may be set in UTC, which negates the need to determine local time.

The GPS time information received by the mobile phone is considered to be delayed by the amount of the propagation time required for the signal to travel from a satellite to the phone. Because each satellite is placed in an orbit approximately 11,000 miles above the ground, the propagation time is at most in the order of tens of milliseconds. Thus, the delay is considered to be negligible for most of applications, including the method of the invention.

In the present invention, each time event that applications handle may be stored in the mobile phone's non-volatile memory in the form of UTC time and time zone, as taught in my U.S. Patent Publication No. 2002/0098857, for Clock for Mobile Phones, filed Jan. 25, 2001. In doing so, such applications are able to handle such a clock, or time, event properly, because, while the GPS time adjustment process described above does not provide time zone information, it does provide reasonably accurate UTC time to the internal clock, which may be used to determine local time.

In one embodiment of the present invention, the mobile station triggers the GPS time adjustment process after a predetermined time elapses between power-up and the last receipt of digital services. In another embodiment, the mobile phone initiates the method of the invention after exhausting all the digital channels that the phone is required to scan at power-up.

Additionally, the method of the invention may be scheduled to be initiated periodically after the passage of a predetermined time to update accurate time until the mobile phone discovers digital services. The period may be predetermined, or dynamically based on the difference between the time obtained from the GPS and the one driven by the internal clock, e.g., if the difference between the GPS signal and the phone clock exceeds a predetermined difference. In the latter case, the larger the error becomes, the more frequently the GPS processing will take place.

This invention also allows users to enable or disable the GPS time processing. In one preferred embodiment, the user interface of the mobile phone may offer the following options:

1. Enable GPS time adjustment
2. Enable GPS time adjustment only if a time event has been armed
3. Disable GPS time adjustment Moreover, when the GPS time adjustment is enabled, the user interface may offer the following options:

1. Periodic GPS time adjustment
2. One-time GPS time adjustment at power-up

Thus, a method and system for a GPS-assisted mobile phone clock for use in non-digital service coverage area has been disclosed. It will be appreciated that further variations and modifications thereof may be made within the scope of the invention as defined in the appended claims.

I claim:

1. A method of setting an internal clock in a GPS-equipped mobile communication device when the mobile communication device is not in a digital service area, comprising:

powering-up the mobile communication device;

determining whether digital service is available, and, if digital service is not available, activating a GPS receiver in the mobile communication device;

detecting a GPS time signal from any GPS satellite, and setting the internal clock in the mobile communication device from the GPS time signal.

2. The method of claim 1 wherein said determining includes determining whether digital service is available by determining the elapsed time from the last receipt of a digital service contact.

3. The method of claim 1 wherein said determining includes determining whether digital service is available by scanning for all possible digital channels.

4. The method of claim 1 wherein said detecting includes detecting after a pre-determined period of time, a GPS time signal to update the internal clock in the mobile communication device.

5. The method of claim 1 wherein said detecting includes detecting a difference between the GPS time signal and the internal clock time, and, if the difference exceeds a predetermined value, updating the internal clock time as a function of the GPS time signal.

6. The method of claim 1 wherein a user interface is provided to allow the user to regulate the GPS time adjustment.

7. The method of claim 1 which further includes detecting location from plural GPS satellites and determining local time as a function of the GPS time signal and location.

8. A method of setting an internal clock in a GPS-equipped mobile communication device when the mobile communication device is not in a digital service area, comprising:

determining whether digital service is available, including determining whether digital service is available by determining the elapsed time from the last receipt of a digital service contact, and, if digital service is not available, activating a GPS receiver in the mobile communication device;

detecting a GPS time signal from any GPS satellite, and setting the internal clock in the mobile communication device from the GPS time signal.

9. The method of claim 8 wherein said determining includes determining whether digital service is available by scanning for all possible digital channels.

10. The method of claim 8 wherein said detecting includes detecting after a pre-determined period of time, a GPS time signal to update the internal clock in the mobile communication device.

11. The method of claim 8 wherein said detecting includes detecting a difference between the GPS time signal and the internal clock time, and, if the difference exceeds a pre-determined value, updating the internal clock time as a function of the GPS time signal.

12. The method of claim 8 wherein a user interface is provided to allow the user to regulate the GPS time adjustment.

13. The method of claim 8 which further includes detecting location from plural GPS satellites and determining local time as a function of the GPS time signal and location.

* * * * *